US005266756A

United States Patent [19]

Hatano

[11] Patent Number: 5,266,756

[45] Date of Patent: Nov. 30, 1993

[54] CONTROL APPARATUS FOR HYDRAULIC ELEVATORS USING FUZZY LOGIC AND SPEED CONTROL

[75] Inventor: Kazuhiro Hatano, Kanagawa, Japan

[73] Assignee: Kabushiki Kaisha Toshiba, Kawasaki, Japan

[21] Appl. No.: 665,647

[22] Filed: Mar. 7, 1991

[30] Foreign Application Priority Data

Mar. 7, 1990 [JP] Japan ..... 2-053759

[51] Int. Cl.[5] ..... B66B 9/04

[52] U.S. Cl. ..... 187/111; 187/29.2; 187/116

[58] Field of Search ..... 364/424.1, 426.02, 426.01, 364/426.05, 440; 187/111, 110, 118, 116, 29.2

[56] References Cited

U.S. PATENT DOCUMENTS

| | | | |
|---|---|---|---|
| Re. 33,171 | 2/1990 | Ogasawara et al. | 187/111 |
| 4,760,896 | 8/1988 | Yamaguchi | 187/124 |
| 4,775,031 | 10/1988 | Nakamura et al. | 187/111 |
| 4,852,007 | 7/1989 | Yasunobu et al. | 364/426.01 |
| 5,001,640 | 3/1991 | Matsumoto et al. | 364/426.02 |

FOREIGN PATENT DOCUMENTS

| | | |
|---|---|---|
| 2195792 | 4/1988 | United Kingdom . |
| 2215488 | 9/1989 | United Kingdom . |

OTHER PUBLICATIONS

Proc. 5th Conference on Artificial Intelligence Applications, 1989, pp. 287-294, S. Tsuji, et al., "Application of the Expert System to Elevator Group-Supervisory Control".

*Primary Examiner*—Emanuel T. Voeltz
*Assistant Examiner*—Robert Nappi
*Attorney, Agent, or Firm*—Oblon, Spivak, McClelland, Maier & Neustadt

[57] ABSTRACT

A control apparatus for hydraulic elevators, including: a flow control valve for controlling the amount of oil in a hydraulic jack; a sensor device for detecting at least one of oil temperature and load pressure and producing corresponding input data; a correcting rule storing device for storing correcting rules of control instruction values corresponding to input data from the sensor device; a fuzzy reasoning processor for calculating control instruction values as fuzzy values from the input data and the correcting rules; a speed pattern correcting circuit for correcting the control instruction values based on the fuzzy values calculated by the fuzzy reasoning processor; and a speed controlling device for supplying the corrected control instruction values to the valve.

2 Claims, 11 Drawing Sheets

| RULE No. | SENSOR INPUT DATA | | CORRECTING CURRENT DATA | | |
|---|---|---|---|---|---|
| | LOAD PRESSURE | OIL TEMPERATURE | SPEED | ACCELERATION | DECELERATION |
| 1 | PB | PB | Iv1 | Ia1 | Id1 |
| 2 | ZO | PB | Iv2 | Ia2 | Id2 |
| 3 | NB | PB | Iv3 | Ia3 | Id3 |
| 4 | PB | ZO | Iv4 | Ia4 | Id4 |
| 5 | ZO | ZO | Iv5 | Ia5 | Id5 |
| 6 | NB | ZO | Iv6 | Ia6 | Id6 |
| 7 | PB | NB | Iv7 | Ia7 | Id7 |
| 8 | ZO | NB | Iv8 | Ia8 | Id8 |
| 9 | NB | NB | Iv9 | Ia9 | Id9 |

Fig. 6.

| TEMPERATURE / PRESSURE | LOW | MIDDLE | HIGH |
|---|---|---|---|
| LOW | 11 | 12 | 13 |
| MIDDLE | 14 | 15 | 16 |
| HIGH | 17 | 18 | 19 |

CONTROL APPARATUS FOR HYDRAULIC ELEVATORS USING FUZZY LOGIC AND SPEED CONTROL

BACKGROUND OF THE INVENTION

1. Field of the Invention

This invention relates to a control apparatus for hydraulic elevators.

2. Description of Background

In general, hydraulic elevators are controlled by flow control valves.

According to the conventional control method, in the case of rising of an elevator cage, a hydraulic pump is operated at a constant speed, and the speed of the cage is controlled by a flow control valve. Unnecessary discharge of the pump is flowed back to a tank. In the case of descending of the cage, the speed of the cage is controlled by controlling oil flow from a hydraulic cylinder to the tank owing to the cage weight.

In this control method, oil temperature is raised by energy loss, because the oil is circulated in rising operation. During a descending operation, the potential energy of the cage is consumed as pyrexia of oil.

The oil flow through the valve is controlled by a speed controller so as to run the cage with a predetermined speed pattern. If oil temperature and load pressure are constant values, an actual run curve accords with the speed pattern "A" shown in FIG. 14.

In FIG. 14, the cage is started by an activate command, and accelerated to the rated speed V0. The cage is raised to the point of a decelerating switch, and starts deceleration for stopping at a floor. The cage is raised at a constant leveling speed V1, and stopped at the point of a stopping switch. But, oil temperature varies for the above mentioned reason, and load pressure varies in dependence on the actual number of passengers. The variations of oil temperature and load pressure cause variation in the viscosity of the oil. As a result, the run curve does not accord with the speed pattern because the volumetric efficiency of the hydraulic pump is lowered due to variation in the viscosity of the oil.

When the cage is rising, the discharge of the hydraulic pump decreases when the temperature or pressure is a high value. The discharge increases when the temperature or pressure is a low value. The curve "B" of FIG. 14 indicates an actual run curve when the oil temperature or load pressure is a high value. The curve "C" indicates an actual run curve when the oil temperature or load pressure is a low value. When the cage is descending, the opposite phenomena are occurred.

In the case of the run curve "B", the service for passengers become worse because it takes a long time to run between floors. In the case of the run curve "C", the cage does not stop at floors smoothly, and passengers feel uncomfortable. In order to solve these problems, variable speed patterns are prepared so that actual run curves coincide with the pattern "A" without relation to variations of load pressure and oil temperature. Actually, suitable parameters are selected from a parameter table corresponding to input data from an oil temperature sensor and a load pressure sensor.

As it is difficult to model the characteristics of the valve with physical rules, a statical model is used generally. But to make a statical model it is necessary to obtain many homogeneous data. A large amount of manpower and a long time are required to obtain these data. As the concept of the term "homogeneous data" is not definite, if many data are obtained, the data may not indicate the exact characteristics of the hydraulic elevator. Furthermore, the data can not be adaptable to all hydraulic elevator systems for lack of commonality.

Further difficulty in modeling characteristics of the valve with physical rules occurs because the characteristics of hydraulic system are varied for various reasons, for example, oil temperature, load pressure and hydraulic pipe length.

Also, recently fuzzy reasoning theory has been developed and various applications therefore considered. Reference is made to Mamdani et al, "Fuzzy Reasoning and its Applications", Acedemic Press, Inc., 1981, and Dubois et al, "Fuzzy Sets and Systems: Theory and Application", Academic Press Inc., 1980 as background reference materials in the field of fuzzy reasoning.

SUMMARY OF THE INVENTION

Accordingly, it is an object of the present invention to provide a novel control apparatus for a hydraulic elevator which enables an elevator cage to run with an adequate run curve under various circumstances.

The above object and other objects are achieved according to the present invention by providing a novel control system for a hydraulic elevator system, including a flow control valve for controlling the amount of oil in a hydraulic jack, a sensor for detecting oil temperature and/or load pressure, a correcting rule memory for storing correcting rules of control instruction values corresponding to input data from the sensor, a fuzzy reasoning processor for calculating control instruction values as fuzzy values from the input data and the correcting rules, a speed pattern correcting circuit for correcting the control instruction values based on the fuzzy values calculated by the fuzzy reasoning processor, and a speed controlling circuit for supplying the corrected control instruction values to the valve.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a chart illustrating rules stored in the automatic correcting circuit;

DESCRIPTION OF THE PREFERRED EMBODIMENTS

Figure 1:
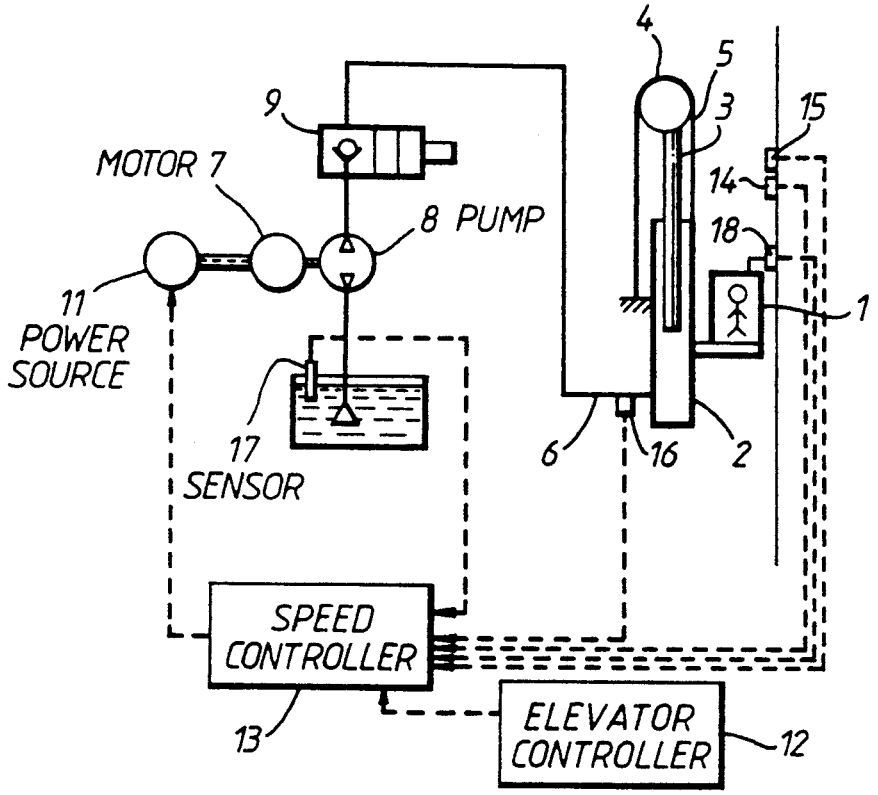
FIG. 1 is a schematic illustration of a hydraulic elevator.

Referring now to the drawings, wherein like reference numerals designate identical or corresponding parts throughout the several views, and more particularly to FIG. 1 thereof, there is shown a hydraulic elevator in which a cage 1 is suspended by a rope 5, and the rope 5 is stretched by a pulley 4. The pulley 4 is lifted or pulled down by a plunger 3 of a hydraulic jack 2. Oil is supplied to the hydraulic jack 2 by a hydraulic pump 8 through a valve 9 and a hydraulic pipe 6. Oil flows back to a tank 10 through the hydraulic pipe 6. The pump 8 is driven by a motor 7 connected as power source 11.

An elevator controller 12 controls the total operation of the hydraulic elevator. A speed controller 13 controls the speed of the cage 1. In order to supply necessary signals to the speed controller 13, a decelerating switch 14 and a stop switch 15 are installed in a shaft near each floor, a temperature sensor 17 is installed in the tank 10, and a speed detector 18 is installed in the cage 1.

Figure 2:
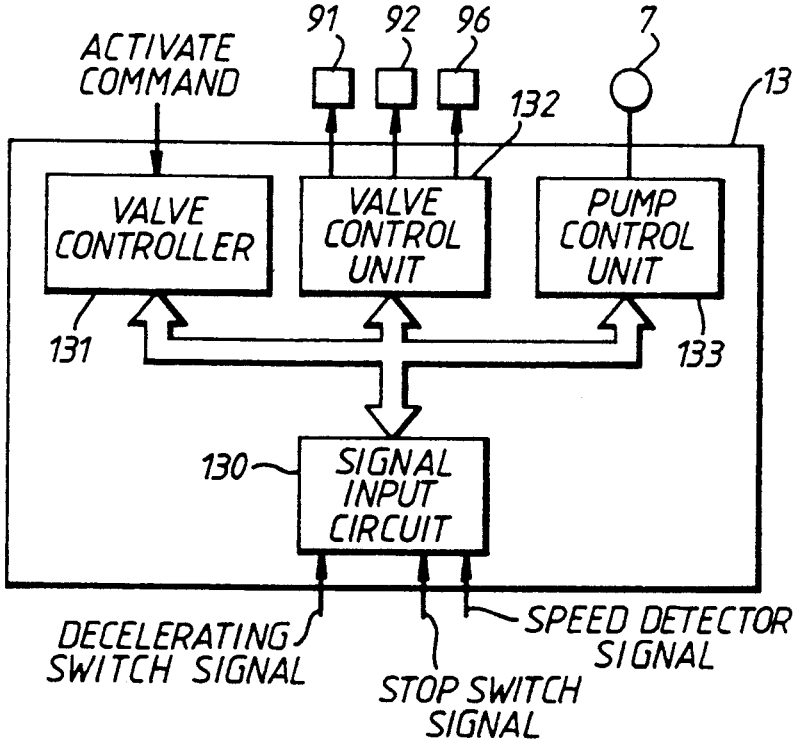
FIG. 2 is a block diagram of the speed controller for a hydraulic elevator.

The speed controller 13 is constituted as shown in FIG. 2.

A signal input circuit 130 is supplied digital signals from the decelerating switch 14, the stop switch 15 and the speed detector 18. A valve controller 131 generates a speed pattern according to an operating instruction from the elevator controller 12. A valve control unit 132 feeds a control signal to the valve 9 according to the speed pattern. The valve 9 includes a valve 91 for rising, a valve 92 for descending and a check valve 96. A pump control unit 133 drives the motor 7.

Installation of the oil temperature sensor 17 is not limited to in the tank 10. Instead, the oil temperature sensor 17 may be installed at the jack 2 or the pipe 6. Although detecting oil temperature and load pressure is described, it is also possible to detect valve temperature, tank temperature or oil flow value.

When the cage 1 is stopping, the valve 9 is closed. The motor 7 is started by the activate command from the elevator controller 12. The valve 9 is controlled according to the speed pattern, and the cage 1 is controlled by controlling oil flow into the hydraulic jack 2.

Figure 3:
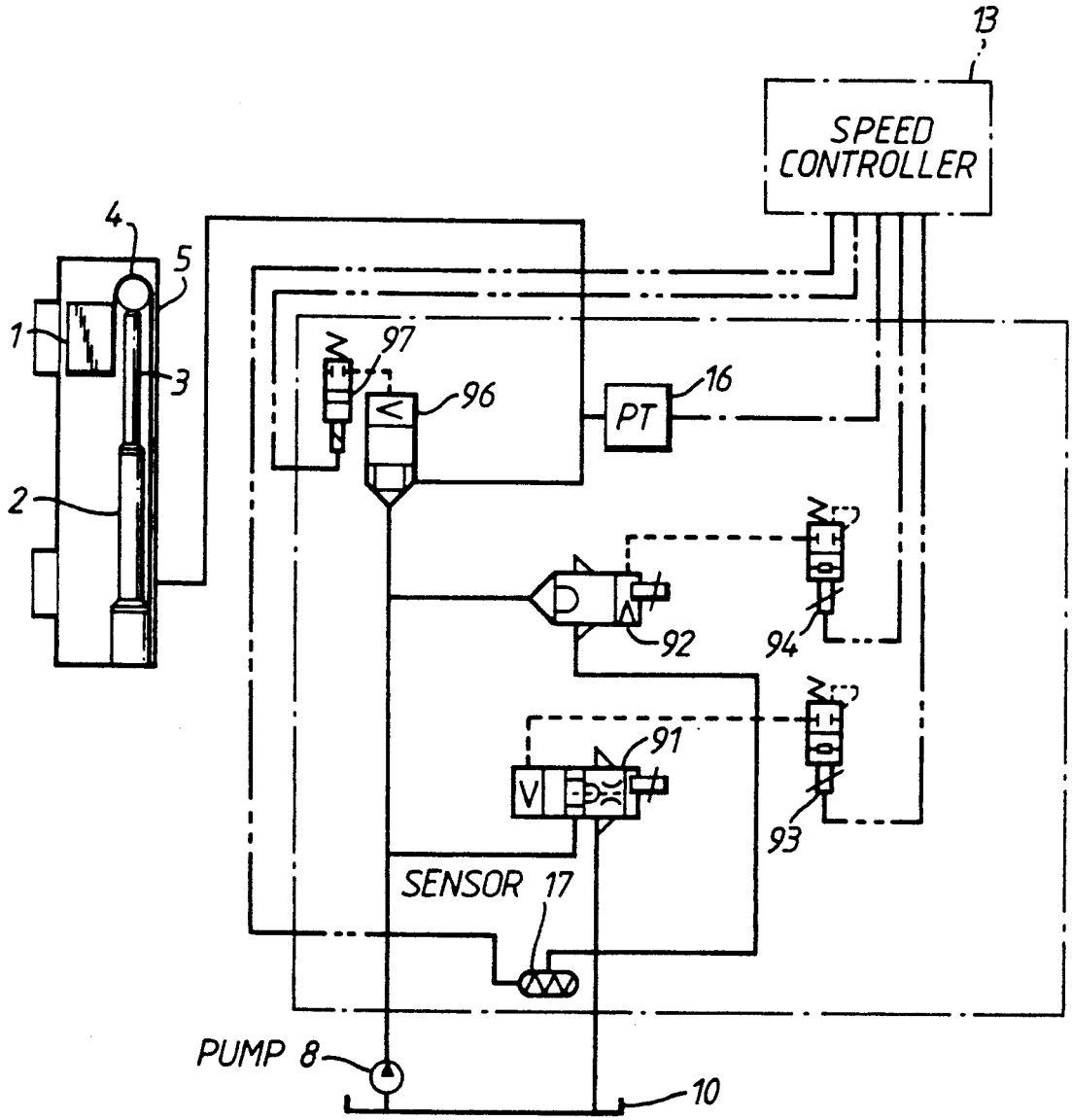
FIG. 3 is a schematic diagram of a valve of the hydraulic elevator.

The detailed construction of the valve 9 is shown in FIG. 3.

During rising operation, the valve is controlled as follows.

The pump 8 is activated by a instruction "UP". When the cage 1 is stopping, a flow control valve 91 is opened completely and all of the oil discharged by the pump 8 flows back into the tank 10 through the flow control valve 91.

An electromagnetic proportional pilot control valve 93 is operated by control current, and the flow control valve 91 is operated to close. As a result of the operation of the flow control valve 91, the oil flow to the tank 10 decreases. On the other hand, the residual oil flows into the cylinder of the hydraulic jack 2 through a stroke sensor 95 and a check valve 96, and the cage 1 rises.

During a descending operation, an electromagnetic proportional pilot control valve 94 is operated by a "DOWN" instruction, and a flow control valve 92 is operated to open. As a result of the operation of the flow control valve 92, the oil in the cylinder of the hydraulic jack 2 flows into the tank 10, and the cage 1 descends.

If the valve is controlled according to a fixed speed pattern AO without relation to change of the oil temperature and load pressure, actual run curves vary according to change of characteristics of the oil.

It is necessary that various patterns should actually be generated for running in spite of changes in predetermined pressure and temperature.

Figure 5:
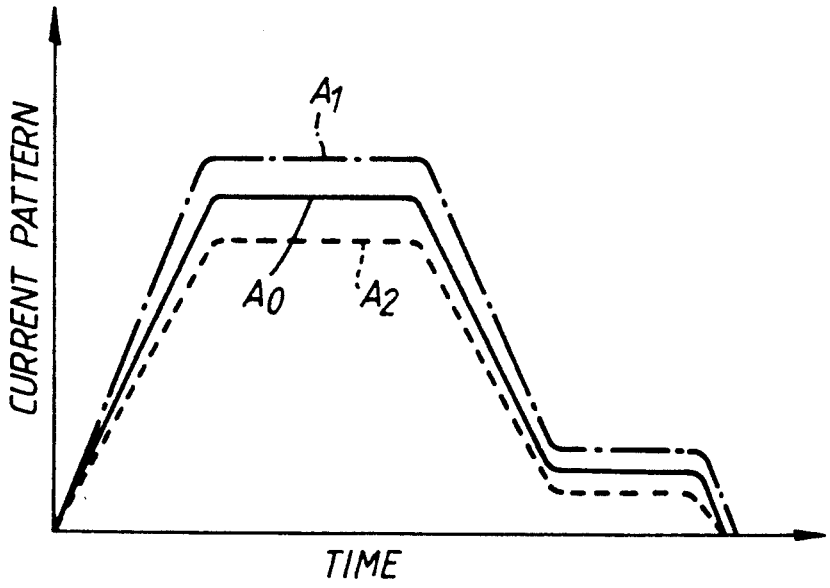
FIG. 5 is a graph illustrating speed patterns, which are generated by the controller of the invention.

In the case of high load pressure and high oil temperature, the elevator speed is lowered by small discharge because the volumetric efficiency of the hydraulic pump 8 lowers. An elevated elevator speed pattern like the pattern Al in FIG. 5 is then required.

In the case of low load pressure and low oil temperature, the elevator speed is raised by large discharge. A lowered elevator speed pattern like the pattern A2 in FIG. 5 is then required.

Figure 4:
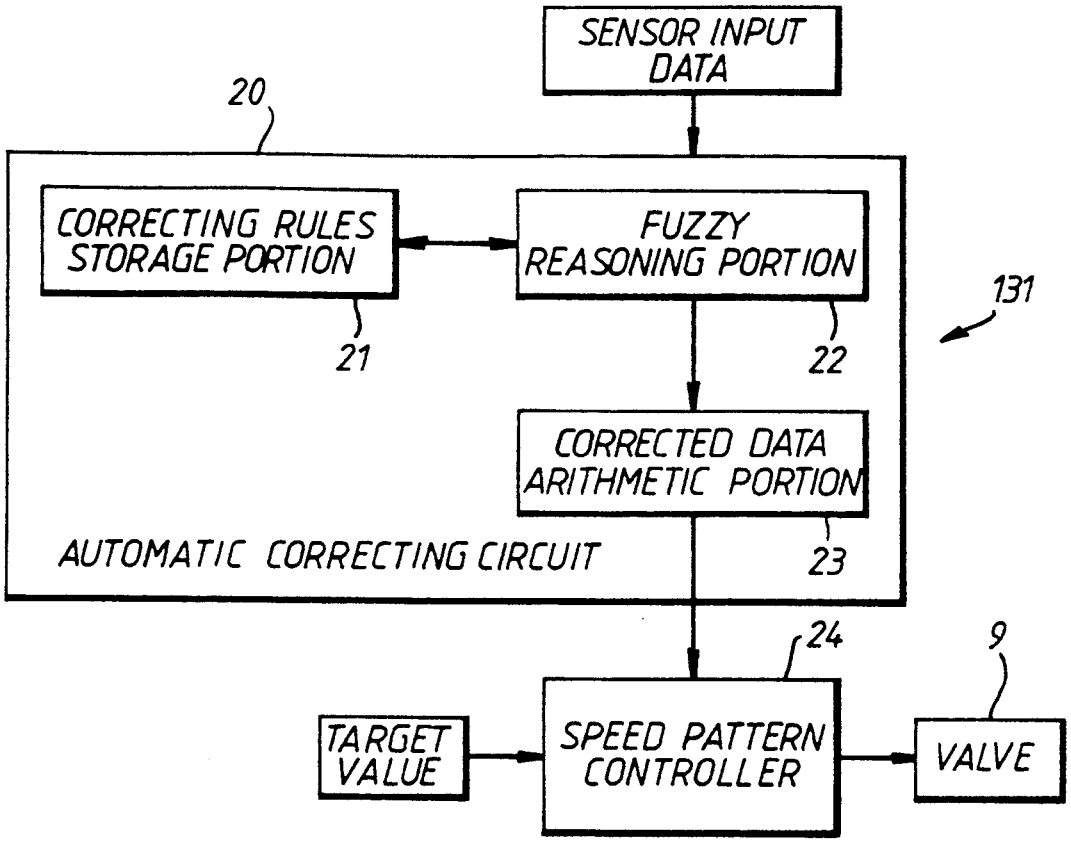
FIG. 4 is a block diagram of the automatic correcting circuit, which is installed in the speed controller of the first embodiment of the invention.

An automatic correcting circuit 20 is constituted as shown in FIG. 4.

A target value is fed to a speed pattern controller 24. The speed pattern controller 24 feeds a speed control current value to the valve 9. The automatic correcting circuit 20 executes a correction of the speed control current value according to the variations of oil temperature and load pressure.

The automatic correcting circuit 20 include a correcting rules storage portion 21, a fuzzy reasoning portion 22 and a corrected data arithmetical portion 23. The correcting rules storage portion 21 stores correcting rules. The fuzzy reasoning portion 22 executes fuzzy reasoning with correcting rules and input data from the load pressure sensor 16 and the oil temperature sensor 17, and outputs correcting current values for the speed control current values which are supplied as the results of fuzzy reasoning to the speed pattern controller 24.

The correcting rules storage portion 21 stores rules for using the control instruction data of speed, acceleration and deceleration corresponding to load pressure and oil temperature as shown in FIG. 6.

Figure 7:
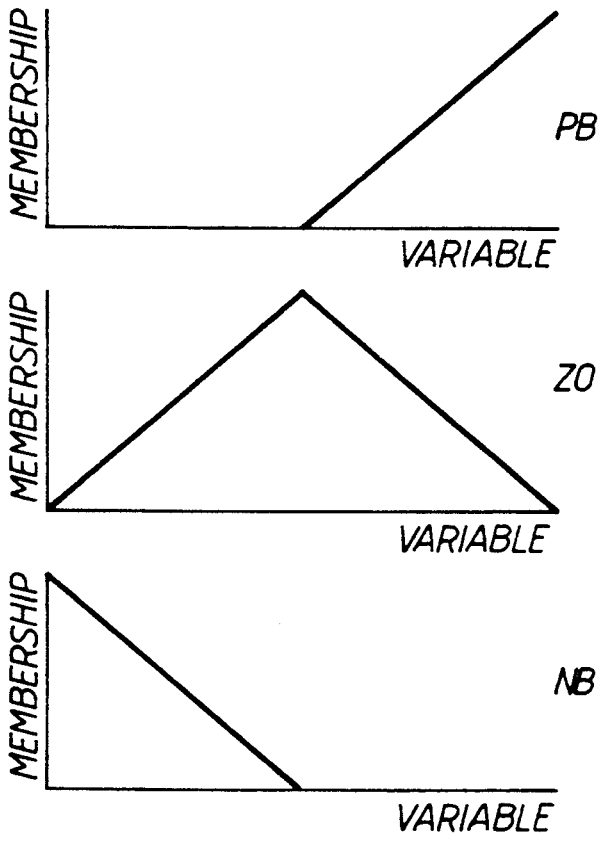
FIG. 7 is an illustration of membership functions for calculating membership values.

The input data from the sensors 16, 17 are represented with fuzzy variables PB, ZO and NB, which respectively correspond to "High", "Middle" and "Low". These fuzzy variables are continuous variables, defining membership functions which are triangular type functions as shown in FIG. 7.

The data Iv1, Ia1, Id1, . . . , Iv9, Ia9, Id9 in FIG. 6 are determined by experimental knowledge and storage of know how. These data represent correcting current for the control current corresponding to rated speed, acceleration and deceleration of a speed pattern for each of the rules 1-9 shown in FIG. 6. The correcting current values corresponding to speed, acceleration and deceleration are obtained by combination of the sensor input data.

The correcting current data of the rule 1 and the rule 9 are determined by the minimum and maximum correcting current values so as to limit the range of correcting current value obtained by fuzzy reasoning.

Fuzzy reasoning is executed by means of the following three steps.

1) Obtaining oil temperature t and load pressure p, which are input data from the sensors.

2) Calculating membership values for the sensor input data. The membership values of the fuzzy variables PB, ZO and NB are obtained from the membership functions as shown in FIG. 7. Thus, the membership values $\theta_{p1} \ldots \theta_{p9}$, $\theta_{t1} \ldots \theta_{t9}$ are obtained for the nine rules. For example, in the rule 1, $\theta_{p1}$ has the value of PB, and $\theta_{t1}$ has the value of PB.

And, as shown in the equation (1) below, the smaller values between the membership values $\theta_p$ and $\theta_t$ are obtained as membership values $\theta_1 \sim \theta_9$.

$$\begin{aligned}
\theta_1 &= \min(\theta_{p1}, \theta_{t1}) \\
\theta_2 &= \min(\theta_{p2}, \theta_{t2}) \\
\theta_3 &= \min(\theta_{p3}, \theta_{t3}) \\
\theta_4 &= \min(\theta_{p4}, \theta_{t4}) \\
\theta_5 &= \min(\theta_{p5}, \theta_{t5}) \\
\theta_6 &= \min(\theta_{p6}, \theta_{t6}) \\
\theta_7 &= \min(\theta_{p7}, \theta_{t7}) \\
\theta_8 &= \min(\theta_{p8}, \theta_{t8}) \\
\theta_9 &= \min(\theta_{p9}, \theta_{t9})
\end{aligned} \tag{1}$$

3) Composing the respective correcting current of the membership values and rules by forming a weighted average.

Composing of a speed weighted average is performed as follows:

$$I_v = \sum_{i=1}^{9} (\theta_i \times I_{vi}) / \sum_{i=1}^{9} \theta_i$$

Composing of an acceleration weighted average is performed as follows:

$$I_a = \sum_{i=1}^{9} (\theta_i \times I_{ai}) / \sum_{i=1}^{9} \theta_i$$

Composing of a deceleration weighted average is performed as follows:

$$I_d = \sum_{i=1}^{9} (\theta_i \times I_{di}) / \sum_{i=1}^{9} \theta_i$$

Though the correcting current data in the latter part of the rules are defined as discrete values in the above-mentioned method, the data also can be defined as functions of the load pressure and the oil temperature.

Figure 8:
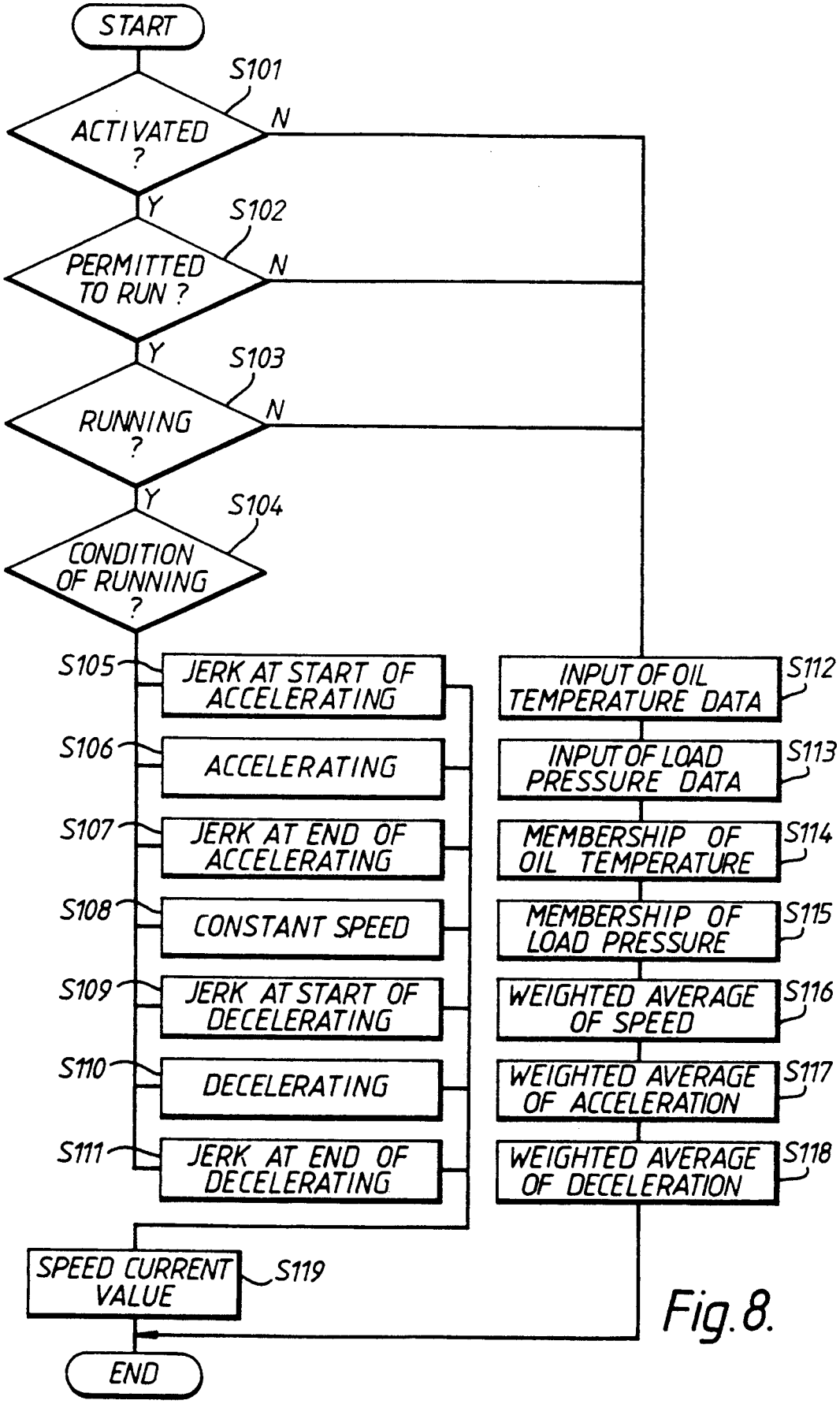
FIG. 8 is a flowchart of a process for obtaining speed current values.

Referring to FIG. 8, the output of the speed current pattern is processed according the following steps First, if an activate command is supplied by the elevator controller 12 when the elevator is stopping, the condition of a step S101 becomes "Yes". Next, at a step S102, if the closure of doors and other protecting operations are confirmed, the condition of a step S102 becomes "Yes". Then, the condition of a step S103 becomes "No", and the next step is S112.

Data are obtained from the oil temperature sensor 17 at a step S112, and from the load pressure sensor 16 at a step S113.

At a step S114, the membership values of the oil temperature corresponding to the former part of the rules in FIG. 6 are calculated. At a step S115, the membership values of the load pressure are calculated.

The correcting current values are obtained by composing correcting current values of all rules using weighted average.

The speed correcting current value is obtained at a step S116, the acceleration correcting current value is obtained at a step S117, and the deceleration correcting current value is obtained at a step S118.

In the case that the elevator cage is stopping at a floor, the condition of the step S103 is "Yes", and next step is S104. At the step S104, speed current patterns are generated corresponding to the condition of elevator running.

At a step S105, a jerk pattern for starting acceleration is generated. After the acceleration reaches a predetermined value, at a step S106, the acceleration is held at a constant value. The predetermined value of acceleration is obtained by adding a predetermined acceleration current value stored in the valve controller 131 and the acceleration correction current value. When the speed reaches a predetermined value, at a step S107, a jerk pattern for ending acceleration is generated. At the point of reaching a rated speed, at a step S108, the speed is held at a constant value. The rated speed is obtained by adding a predetermined speed current value stored in the valve controller 131 and the speed correcting current value.

When the cage 1 comes to a start deceleration point, at a step S109, a jerk pattern for starting deceleration is generated. After the deceleration reaches a predetermined value, at a step S110, the deceleration is held at a constant value. The predetermined value of deceleration is obtained by adding a predetermined deceleration current value stored in the valve controller 131 and the deceleration correcting current value.

When the cage 1 comes to a point at a predetermined distance before the floor to be stopped, at a step S111, a jerk pattern for ending deceleration is generated and the cage 1 is stopped at the floor.

At a step S119, a new speed value, a new acceleration value and a new deceleration value are obtained as predetermined values for a next correction of a speed pattern.

According to the above mentioned embodiment, it is possible to run the cage with a target curve, if oil temperature and load pressure vary.

Figure 9:
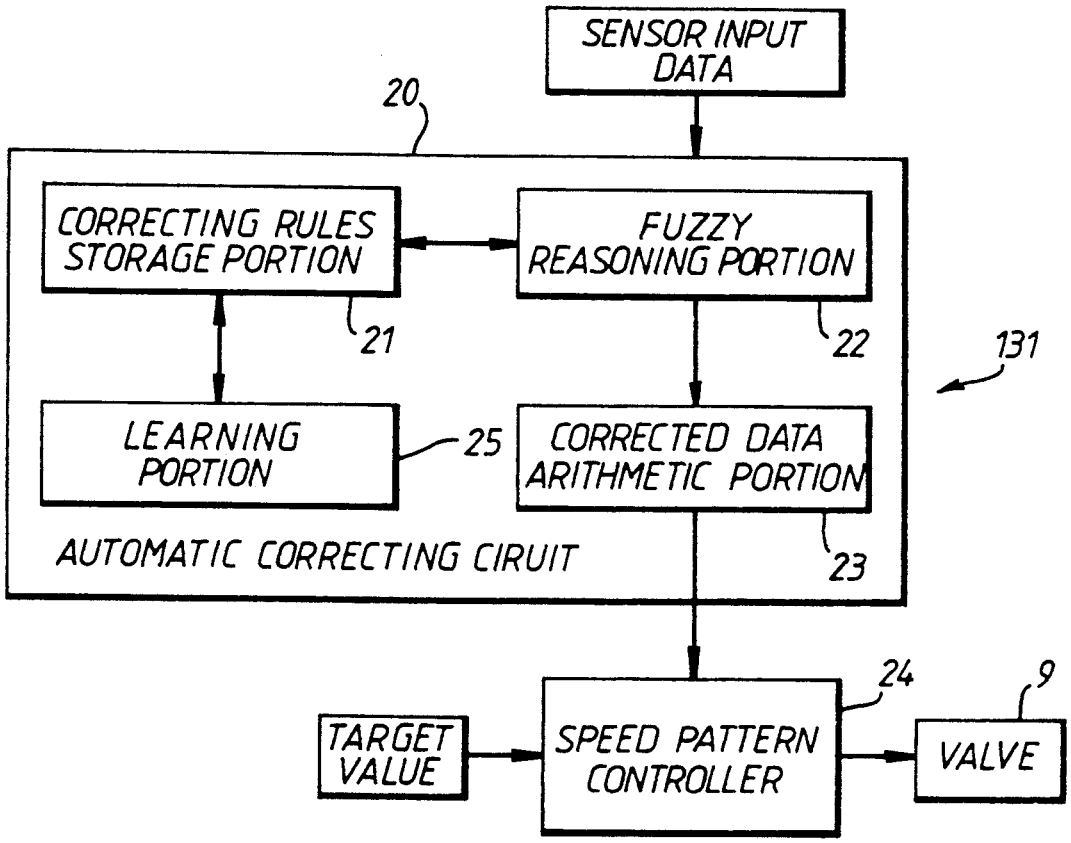
FIG. 9 is a block diagram of an automatic correcting circuit installed in the speed controller of a second embodiment of the invention.

In the second embodiment, as shown in FIG. 9, a learning portion 25 is added in the automatic correcting circuit 20 shown in FIG. 2.

The fuzzy reasoning portion 22 executes fuzzy reasoning of correcting current for the valve control current value.

The learning portion 25 executes a learning operation of automatically correcting the control current values in a later portion of fuzzy reasoning rules according to the difference between the target speed and the actual speed of a speed pattern corrected by fuzzy reasoning.

In the second embodiment, it is defined that a reference oil temperature t0, a reference load pressure p0 and a control current I0 in the case of that the oil temperature is t0 and the load pressure is p0. A speed control current is tuned automatically so that a correcting current value becomes zero when the oil temperature is t0 and the load pressure is p0. Then a correcting current value is calculated from an actual speed control current value and a difference between an actual speed and a target speed, and stored as a learning data.

Figures 10, 11:
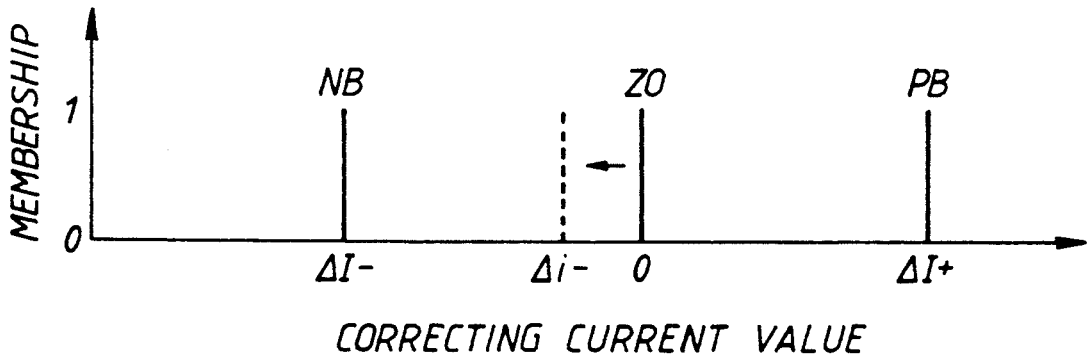
FIG. 10 is an illustration of a correcting current value table.
FIG. 11 is an illustration of a relation between correcting current values and a membership.

Among the data in the correcting current value table shown in FIG. 10, only a correcting current value I5 is changeable by learning. I5 is the correcting current value in the case of that the oil temperature and the load pressure are "Middle" respectively. Otherwise, if all data in the correcting current value table were changeable during learning, correcting current values obtained by fuzzy reasoning may cause a divergence.

In FIG. 11, at the first condition, PB is $\Delta I^+$, ZO is 0 (zero), NB is $\Delta I$. As a result of learning, if the correcting current value, in the case of that the oil temperature and the load pressure are "Middle", decreases $\Delta i^-$ from 0 (zero), the position of ZO moves to the left. However, the positions of PB and NB are constant values without relation to the learning.

Figure 15:
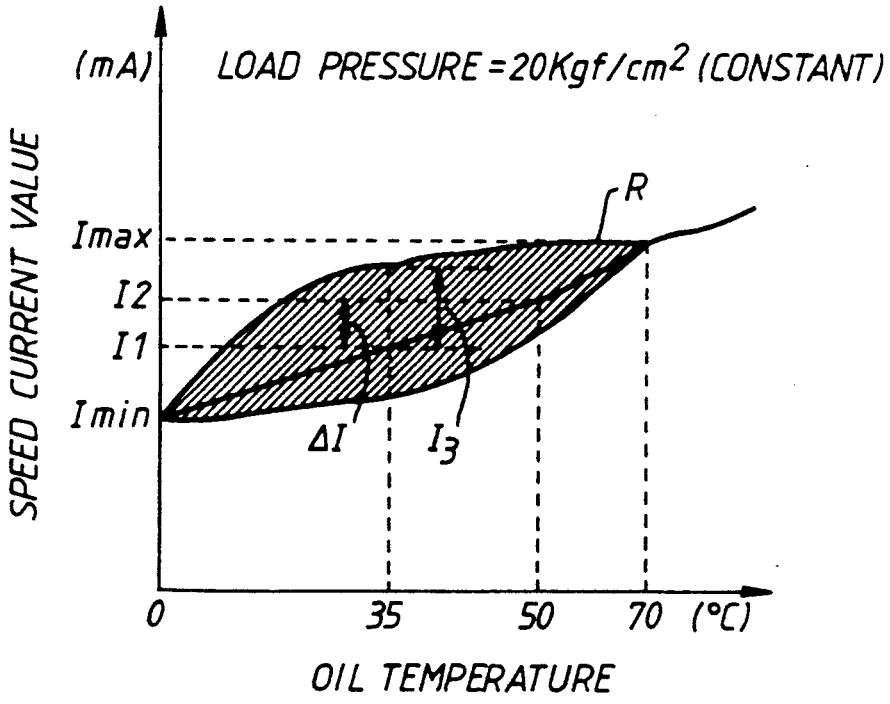
FIG. 15 is a graph illustrating a relation between speed, current values and oil temperature.

FIG. 15 shows correcting of the speed current corresponding to the oil temperature in the case that the oil temperature range of the hydraulic elevator is controllable is 0° C.-70° C. The controlling current value Il is set at installation for running at the rated speed V1 in the case that a standard oil temperature is 35° C. and a standard load pressure is 20 kgf/cm$^2$.

When the oil temperature is 50° C., the cage runs at actual speed V2(V1>V2) with controlling current value 12 that is the result of adding correcting current $\Delta$i. to the controlling current value I1. In this case, it is considered that the controlling current I2 is not an adequate value.

Accordingly, a controlling current at 35° C. (standard oil temperature) and 20 kgf/cm$^4$ (standard load pressure) is calculated from the data at 50° C.

This controlling current value is obtained by linear approximation.

$$V1:(V1-V2)=I1:I3$$

The controlling current value is reset by the value (I1+I3).

As a result, the position of ZO is moved to the right in FIG. 11. The range of a controlling current value at 35° C. and 20 kgf/cm$^2$ is limited as Imin-Imax in FIG. 15, because the position of PB and NB are constant values without relation to learning.

Accordingly, the range of the controlling current values obtained by fuzzy reasoning is limited to a region R. The speed control of the hydraulic elevator prevents large damage, even if the microcomputer of the automatic correcting circuit enters an abnormal state.

The learning operation is executed by means of the following steps.

1) Obtaining data of speed V, acceleration A and deceleration D with a constant interval.

2) Calculating average of the data, as follows:

$$V_{ave} = \sum_{i=1}^{N} V_i$$

$$A_{ave} = \sum_{i=1}^{N} A_i$$

$$D_{ave} = \sum_{i=1}^{N} D_i$$

3) Calculating differences by comparing the average values with theoretical values, as follows:

$$\Delta V = |V_{ave} - V_0|$$

$$\Delta A = |A_{ave} - A_0|$$

$$\Delta D = |D_{ave} - D_0|$$

4) Calculating correcting current values $\Delta I_v$, $\Delta I_a$, $\Delta I_d$ by proportional relation, as follows:

$$\Delta V:V = \Delta I_v:I_v \qquad \Delta I_v = (I_{v0} * \Delta V)/V$$

$$\Delta A:A = \Delta I_a:I_a \qquad \Delta I_a = (I_{a0} * \Delta A)/A$$

$$\Delta D:D = \Delta I_d:I_d \qquad \Delta I_d = (I_{d0} * \Delta D)/D$$

5) Storing the correcting current values as learned data by exponential smoothing, as follows:

$$I_{1dv}=(1-K)*I_{1dv}+K*\Delta I_v$$

$$I_{1da}=(1-K)*I_{1da}+K*\Delta I_a$$

$$I_{1dd}=(1-K)*I_{1dd}+K*\Delta I_d$$

The value K is predetermined so as to have the following relation.

$$(1-K)>K$$

However, at installation of the apparatus, K is set as a larger value because the learning time is then short.

The value K may be changed automatically corresponding to learning times.

i) learn times<10 times $$K=0.8$$

ii) 10 times=learn times<20 times $$K=0.6$$

iii) 20 times≦learn times $$K=0.4$$

The fuzzy reasoning and the learning operation of this embodiment are executed by means of the following steps.

In this embodiment, the output operation of speed current pattern is executed as in the first embodiment shown in FIG. 8.

Figure 12:
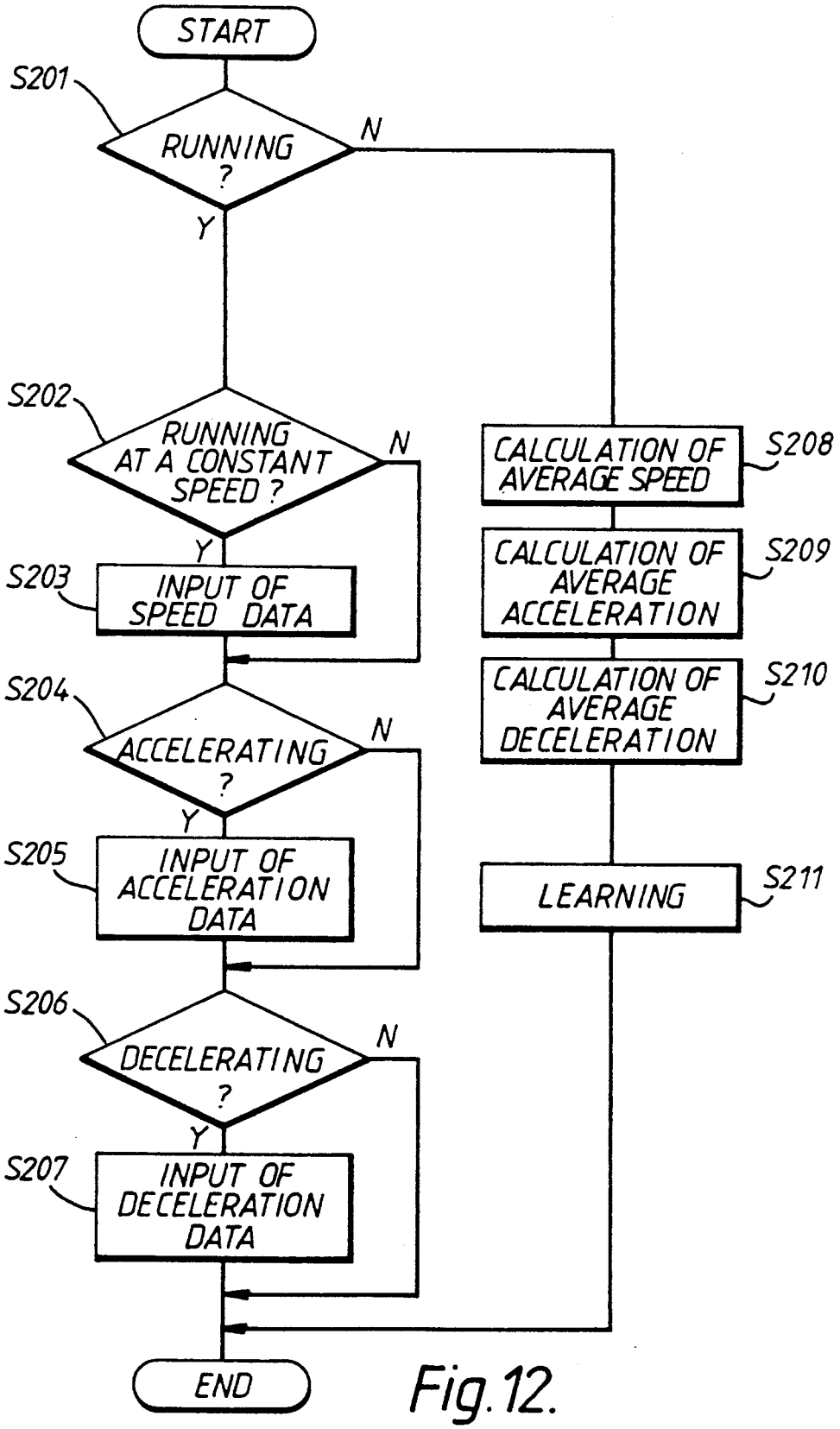
FIG. 12 is a flowchart of a process for a learning operation.
Figure 13:
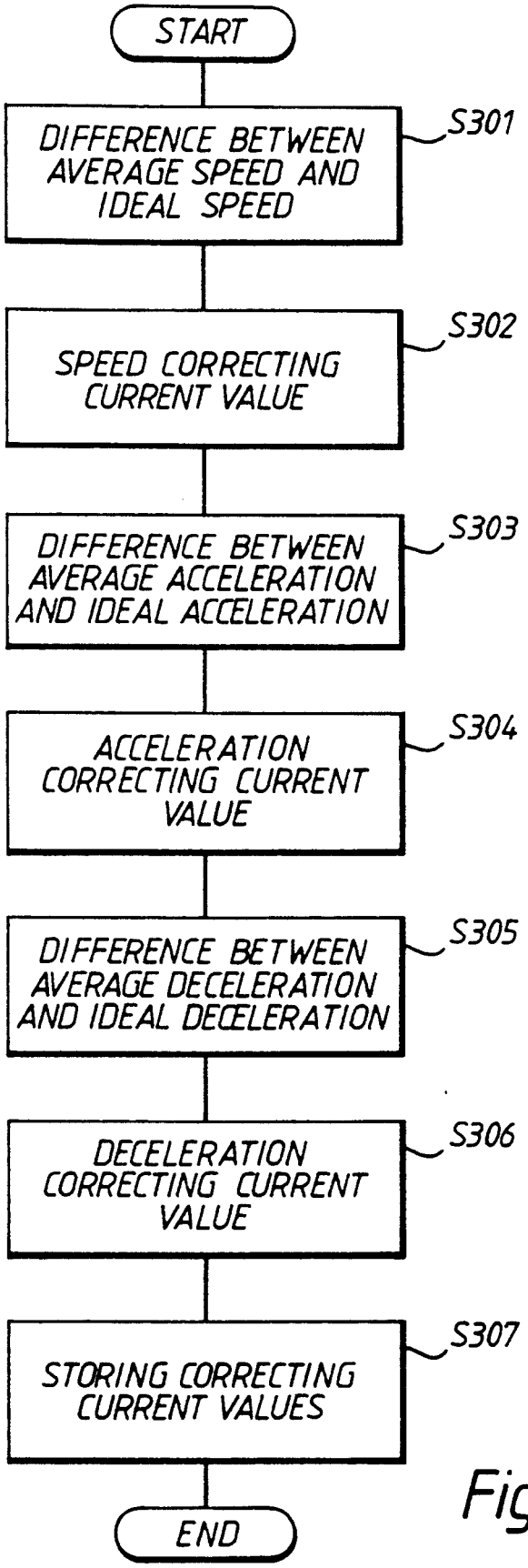
FIG. 13 is a flowchart of the detailed process for a learning operation.
Figure 14:
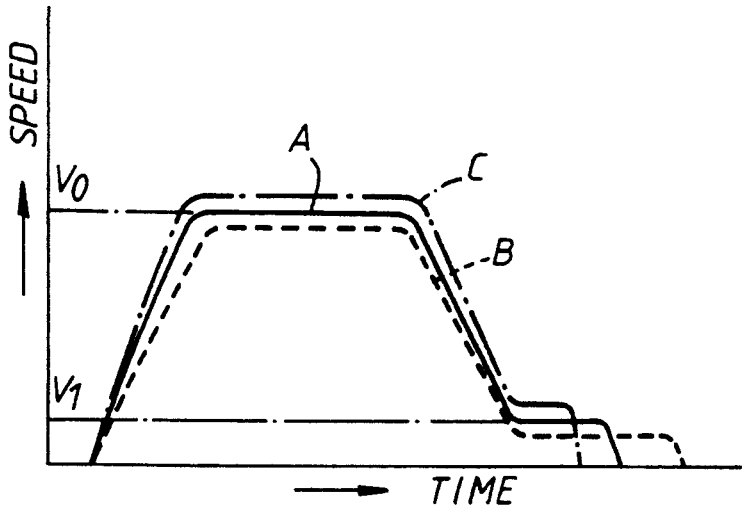
Fig.14. (PRIOR ART)
FIG. 14 is a graph of actual run curves without correction.

The learning operation is executed according to the flowchart shown in FIG. 12 and FIG. 13.

The learning operation includes a process during running and a process during stopping.

In the process during running, the condition of a step S201 is "Yes".

The condition of a step S202 is "Yes" when the cage is running at the rated speed. At a step S203, the actual speed of the cage is detected by the speed detector 18 at a constant interval and stored.

The condition of a step S204 is "Yes" when the cage is being accelerated. At a step S205, the actual acceleration of the cage is detected by the speed detector 18 at a constant interval and stored.

The condition of a step S206 is "Yes" when the cage is being decelerated. At a step S207, the actual deceleration of the cage is detected by the speed detector 18 at a constant interval and stored.

In the process during stopping, the condition of a step S201 is "No". The average value of the actual speed, the actual acceleration and the actual deceleration stored during running are calculated respectively at steps S208-S210. At a step S211, the learning process is executed.

As shown in FIG. 13, at a step S301, a difference between the average speed obtained at the step S208 and the ideal speed (rated speed) is calculated. At a step S302, a speed correcting current value is calculated from the difference speed by the above mentioned method.

At a step S303, a difference between the average acceleration obtained at the step S209 and the ideal acceleration is calculated. At a step S304, an acceleration correcting current value is calculated from the difference value of step S303.

At a step S305, a difference between the average deceleration obtained at the step S210 and the ideal deceleration is calculated. At a step S306, a deceleration correcting current value is calculated from the difference value of step S305.

At a step S307, the correcting current values are stored as learned data.

According to this embodiment, an adequate control can be automatically executed corresponding to various circumstances of operation of the hydraulic elevator by correcting rules.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A control apparatus for hydraulic elevators, comprising;

a flow control valve responsive to signals input thereto for controlling the amount of oil in a hydraulic jack;

sensor means for detecting at least one of oil temperature and load pressure and producing corresponding input data;

correcting rule storing means for storing correcting rules of control instruction values corresponding to input data from said sensor means;

fuzzy reasoning means, connected to said sensor means and said correcting rule storing means, for calculating control instruction values as fuzzy values from said input data nd said correcting rules;

speed pattern correcting means, connected to said fuzzy reasoning means, for correcting said control instruction values based on said fuzzy values calculated by said fuzzy reasoning means;

speed controlling means for receiving said corrected control instruction values and for supplying said corrected control instruction values to said valve;

speed detector means for detecting actual elevator speed; and learning means for updating said correcting rules based on a comparison of said corrected control instruction values with said actual elevator speed;

wherein said learning means comprises:

means for obtaining speed data, acceleration data, and deceleration data over a predetermined interval;

means for determining respective averages of said speed data, acceleration data and said deceleration data;

means for determining respective differences between said average speed and a speed reference value, said average acceleration and an acceleration reference value, and said average deceleration and a deceleration reference value;

means for determining second control instruction values using said control instruction values, said difference values, said speed data, said acceleration data and said deceleration data; and means for exponentially smoothing said second control instruction values and storing exponentially smoothed instruction values.

2. A control apparatus for hydraulic elevators according to claim 1, wherein said means for exponentially smoothing said second control instruction values smooths said values based upon a number of times learning has been executed.

* * * * *